United States Patent [19]

Hoffman

[11] Patent Number: 4,830,361

[45] Date of Patent: May 16, 1989

[54] MULTI-PURPOSE HAND-HELD EXERCISE DEVICE

[76] Inventor: Donald Hoffman, 176 Stewart Ave., East Rochester, Pa. 15074

[21] Appl. No.: 117,031

[22] Filed: Nov. 4, 1987

[51] Int. Cl.[4] ..... A63B 11/08

[52] U.S. Cl. ..... 272/68; 272/117; 272/122

[58] Field of Search ..... 272/67, 68, 117, 122, 272/123, 132, 135, 137, 140, 141, 142, 143, DIG. 4

[56] References Cited

U.S. PATENT DOCUMENTS

| | | | |
|---|---|---|---|
| 1,026,215 | 5/1912 | Korth | 272/122 X |
| 1,552,073 | 9/1925 | Mansfeldt | 272/68 X |
| 4,192,500 | 3/1980 | Crow et al. | 272/68 |
| 4,203,591 | 5/1980 | Gibson | 272/132 X |
| 4,681,315 | 7/1987 | Kang | 272/122 |
| 4,691,915 | 9/1987 | Sutton | 272/122 X |
| 4,753,434 | 6/1988 | Salvino | 272/68 |

FOREIGN PATENT DOCUMENTS

| | | | |
|---|---|---|---|
| 305995 | 6/1915 | Fed. Rep. of Germany | 272/68 |
| 26751 | 12/1898 | United Kingdom | 272/122 |

*Primary Examiner*—Richard J. Apley
*Assistant Examiner*—Robert W. Bahr
*Attorney, Agent, or Firm*—Webb, Burden, Ziesenheim & Webb

[57] ABSTRACT

A hand-held exercise device which provides both grip enhancement and leverage-enhanced weight training in the hand, arm and shoulder during use. This device comprises a coil spring-type gripping device having, detachably mounted thereon, one or more weights whereby the center of mass of the weight may be eccentric to the grip axis of the hand. As a single example, the device may include one elongated weight in a "gun-barrel" position, with performance of curls or other maneuvers of the arms—in conjunction with repetitive gripping and releasing of the handles—resulting in leverage-enhanced exercise. One or two of the present exercise devices may be used, with two devices being preferable for use during jogging or running.

1 Claim, 2 Drawing Sheets

MULTI-PURPOSE HAND-HELD EXERCISE DEVICE

FIELD OF THE INVENTION

The present invention relates to weighted multi-purpose hand-held exercise appliances which provide both grip development and leverage-enhanced weight training.

INTRODUCTION

Fitness equipment systems which incorporate weights generally classify within one of two categories (not including competition-type weights). First, fitness studio equipment frequently emphasizes leverage systems, providing the user with a wide variety of options for exercising and body conditioning. Alternatively, for remote use—i.e., jogging or running—weighted exercise equipment has conventionally concentrated upon the addition of weight in the area of the hands, ankles and feet. A synthesis of the two types of weight-providing exercise devices has, however, remained unavailable. That is, the leverage features ubiquitous in fitness center or weight room equipment have proved uniformly absent from hand-held, ankle or foot weights.

BACKGROUND OF THE INVENTION

U.S. Pat. No. 4,021,040 to Inoue discloses adjustable-weight dumbbells equipped with a grip promoting member at the grasping portion thereof. The grip includes a spring and is mounted in a cantilevered manner to the handle; the dumbbell is grasped in the hand, swung vertically and horizontally for muscular strength training centering around the arm, with grip enforcement being obtained by grasping and squeezing the grip promoting unit against its springing force.

U.S. Pat. No. 4,623,141 to Salvino discloses an improvement on the conventional coil-type hand-held grip enhancing devices. The improvement disclosed by the Salvino patent resides in the provision of means for varying the resistance in the coiled spring by means of an axial rod, washers and wing nuts. U.S. Pat. No. 4,557,479 to Guibert discloses an articulated manual exercise bar designed, not to strengthen the grip, but to enable a user to execute highly complex isotonic exercise of the arms. U.S. Pat. No. 4,623,146 to Jackson discloses a similar exercise device to that of Guibert, without articulations, in that the bar enhances isotonic exercises and is held in both hands for use. U.S. Pat. No. 2,263,135 to Johnson, No. 2,356,260 to Maxwell and No. 2,814,491 to Proctor represent exercise devices from the earlier patented literature.

In view of the failure of prior art hand-held weighted exercise devices to provide both weight and leverage advantages during body conditioning, other than the augmentation of the weight of the hands, a need persists for a hand-held weighted exercise device which makes use of the leverage advantages of muscle training so commonly found in studio fitness systems.

SUMMARY OF THE INVENTION

In order to meet this need, the present invention is a hand-held exercise device which provides both grip enhancement and leverage-enhanced weight training in the hand, arm and shoulder during use. This device comprises a coil spring-type gripping device having, detachably mounted thereon, one or more weights whereby the center of mass of the weight may be eccentric to the grip axis of the hand. For example, one or more weights may be attached to a central weight mount positioned atop the coil spring of a coil spring-type grip device, which weight mount is adapted to permit extension of the weight(s) to a number of pre-set positions. Alternatively, one or more weights may be attached to an adjustable central weight mount, which mount is provided with structure which enables it to rotate relative to the handles of the coil spring-type exercise device on which it is mounted, for infinitely variable selective positioning of the weight. As a single example, the device may include one elongated weight in a "gun-barrel" position, with performance of curls or other maneuvers of the arms—in conjunction with repetitive gripping and releasing of the handles—resulting in leverage-enhanced exercise. One or two of the present exercise devices may be used, with two devices being preferable for use during jogging or running.

DETAILED DESCRIPTION OF THE INVENTION

Figure 1:
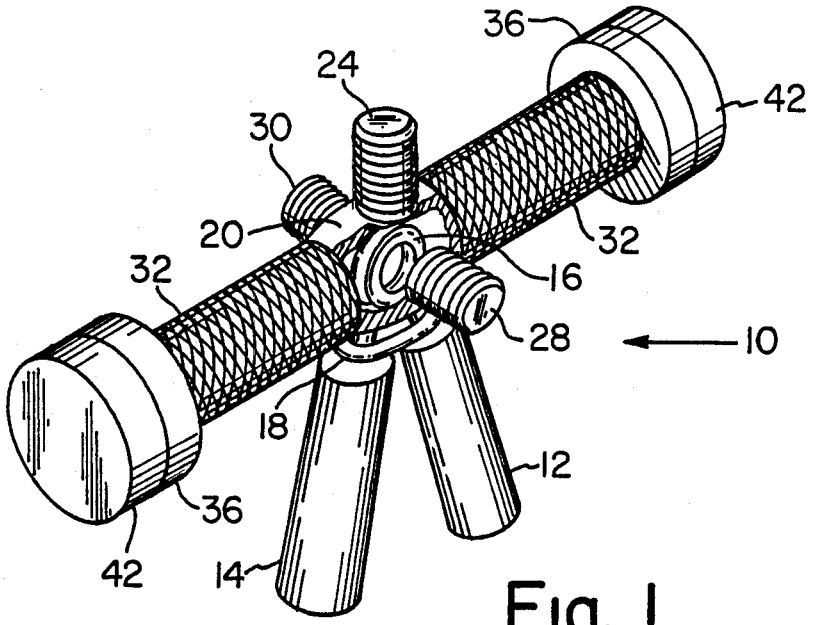
FIG. 1 represents a first embodiment of the present exercise device.
Figure 2:
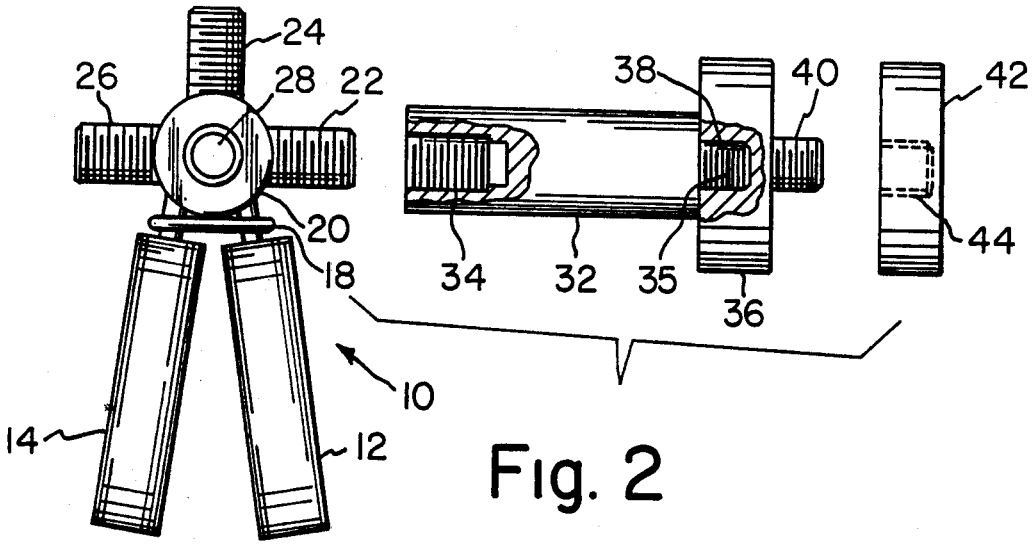
FIG. 2 is an exploded view of the exercise device shown in FIG. 1 (with one lever weight not shown)

Referring first to FIGS. 1 and 2, and especially to FIG. 2, a first embodiment of the present exercise device 10 is shown in an exploded view along with its lever weight 32 and accompanying structures. More particularly, the exercise device 10 comprises a first handle 12, a second handle 14, the handles 12, 14 being connected by means of a coiled spring (not shown), the action of the spring further being controlled by the coiled spring restraining loop 18. A spring housing 20 encases the coiled spring and supports first, second, third and fourth central weight mounts 22, 24, 26, 28 thereon. These weight mounts are adapted to secure added weights as desired by the user and, as shown, comprise cylindrical attachment posts having threads thereon.

As shown in FIG. 2, the exercise device 10 may be fitted with one or more weights in a "gun-barrel" configuration. The lever weight 32 having a cylindrical threaded recess 34 therein may be rotatably mounted directly to the first central weight mount 22 by means of the cooperating threads inherent in the structure as shown. Additional weights append the lever weight 32 as shown: the inner disc weight 36 is affixed to the weight mount 35 of the lever weight 32, said inner weight disc 36 having a cylindrical thread recess 38 therein adapted to receive the weight mount 35, and the inner disc weight 36 also has an outer disc weight mount 40 integral therewith for affixation within the cylindrical threads 44 of the outer disc weight 42. The structure of FIG. 2, when assembled, thus provides a coil spring-type gripping device having exercise weights attached thereto, with the center of mass of the aggregate weights being eccentric to the grip axis of the user. (The "grip axis" is the axis encircled by the fingers and thumb during gripping.) Optionally, two or more lever weights may be used for an even further extension of the "gun-barrel" structure.

Referring now to FIG. 1, the exercise device of FIG. 2 is shown with a pair of lever weights 32 and the accompanying inner disc weights 36 and outer disc weights 42. As may be seen in FIG. 1, as many as three additional lever weights 32 may be added to the exercise device 10 as shown, in any of a number of configurations. Whether the center mass of the aggregate weights is eccentric to the grip of the user may be controlled by the user, such that the desired leverage effect during hand and arm exercise is achieved.

Figure 3:
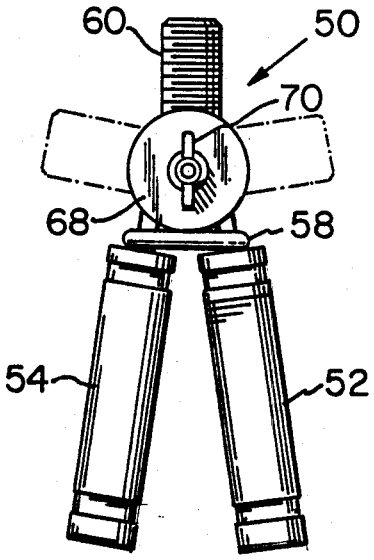
FIG. 3 is a side elevational view of an alternate embodiment of the present invention having a single adjustable central weight mount.
Figure 5:
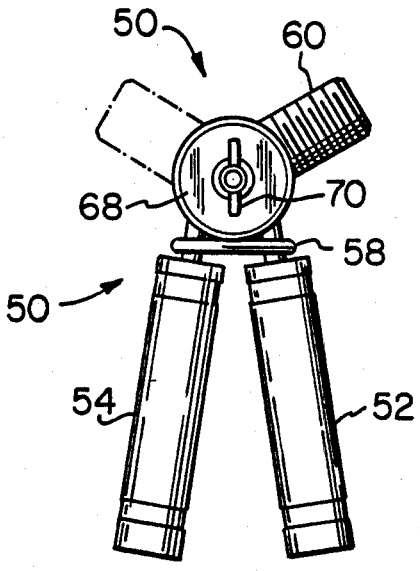
FIG. 5 is a side elevational view of the alternate embodiment as shown in FIG. 3, with the adjustable central weight mount oriented to a different position.
Figure 4:
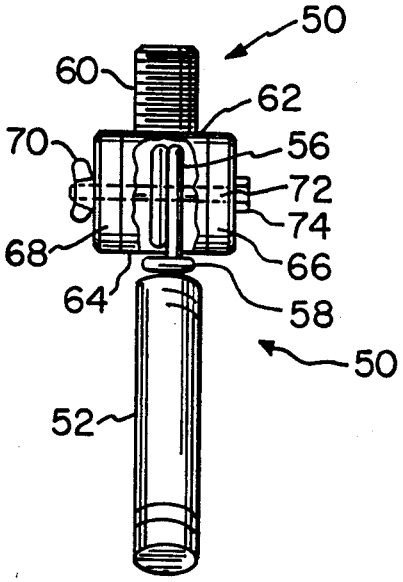
FIG. 4 is a front elevational view of the device according to FIG. 3, taken from the right.

A second embodiment of the invention is illustrated in FIGS. 3–6. The second embodiment of the invention is an adjustable embodiment, in which a single weight mount may be selectively adjusted to a variety of positions along a single path of rotation. Referring now to FIG. 3, the exercise device 50, having a first handle 52 and a second handle 54, bears an adjustable central weight mount 60. As shown in dotted line configuration, the adjustable central weight mount 60 may be rotated to variable positions as desired by the user. Referring now to FIG. 5, two additional positions for the adjustable central weight mount 60 are shown, in the identical view of the adjustable embodiment of the invention as shown in FIG. 3. The handles 52, 54, coil spring (not shown) and coil spring restraining loop 58 of FIGS. 3 and 5 are identical not only with each other but with the first embodiment of the invention described above.

Figure 6:
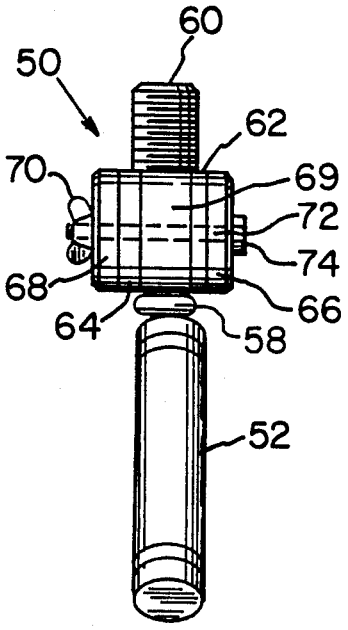
FIG. 6 illustrates a front elevational view of the alternate embodiment of the invention illustrating the first and second central weight mount rings upon which the adjustable central weight mount is affixed.

The structure which enables the variable positioning of the adjustable central weight mount 60 of FIGS. 3 and 5 is best illustrated in FIG. 6. Referring now to FIG. 6, the adjustable central weight mount 60 is integrally formed with both a first and second central weight mount ring 62, 64. The first and second central weight mount rings 62, 64 form a cylinder with a separate sheath 69, which structure is likewise a ring and is positioned between the first and second central weight mount rings 62 and 64. The sheath 69, however, is not attached to the adjustable central weight mount 60 but merely touches it as shown. Cocylindrically with the first and second central weight mount rings 62, 64 and the sheath 69 are the first and second mount plates 66, 68. By means of suitable apertures therein (when necessary, as described below) the structures 60, 62, 64, 66, 68 and 69 are adapted for tightening together by means of a wing nut 70, bolt 72 and bolt head 74. Suitable bolt-receiving apertures are provided in the first and second mount plates 66 and 68; because the sheath 69 and the first and second central weight mount rings 62, 64 together form a housing for the coil spring, no apertures to receive the bolt are needed in these structures. See FIG. 4, in which the hollow chamber created by the sheath 69 and the first and second central weight mount ring 62, 64 is shown.

As a result of the structure of the adjustable embodiment of the invention described above, when the wing nut, bolt and bolt head 70, 72 and 74 are loosened, the integral structure comprising the adjustable central weight mount 60 together with the first and second central weight mount ring 62 and 64 is capable of rotation relative to the first and second mount plates 66, 68 and the sheath 69 coaxial therewith. The adjustable central weight mount 60 may thus be oriented to the desired position, with subsequent tightening of the wing nut 70 together with the bolt 72 and the bolt head 74.

As illustrated by the two embodiments of the invention described above, the present invention includes the combination of a grip-type exercise device with one or more weights adapted for selective positioning with the center of mass of the weights potentially eccentric to (i.e., non-colinear with) the grip axis of the hand. A wide variety of structural adaptations to the embodiments described above may thus be made without compromising the nature of the invention. The invention is therefore to be limited only in accordance with the accompanying claims.

I claim:

1. An exercise device comprising:

means for permitting compression upon gripping by a human hand;

means for attaching a weight to said means for permitting compression, said means for attaching a weight further comprising a housing and a plurality of cylindrical threaded posts affixed to said housing, said cylindrical threaded posts being positioned in more than one plane; and at least one weight, wherein at least one position of said weight on said means for permitting compression results in a center of mass of said weight eccentric to the grip axis of the hand.

* * * * *